United States Patent [19]

Faulkingham

[11] Patent Number: 4,491,268

[45] Date of Patent: Jan. 1, 1985

[54] MAILBOX DELIVERY SIGNAL DEVICE

[76] Inventor: Clifford H. Faulkingham, 3500 Heatherington Rd., Orlando, Fla. 32808

[21] Appl. No.: 525,014

[22] Filed: Aug. 22, 1983

[51] Int. Cl.[3] ..... A47G 29/12

[52] U.S. Cl. ..... 232/35; 232/34

[58] Field of Search ..... 232/34, 35, 36; 116/100, 215; 292/191, 192, 177, 259, 256.5

[56] References Cited

U.S. PATENT DOCUMENTS

| | | | |
|---|---|---|---|
| 1,458,836 | 6/1923 | McDowell | 232/35 |
| 2,130,216 | 9/1938 | Zaninovich | 292/205 |
| 2,433,940 | 1/1948 | Weaver | 232/35 |
| 2,804,262 | 8/1957 | Mancuso | 232/35 |
| 3,516,383 | 6/1970 | Goodman | 232/35 |
| 3,523,639 | 8/1970 | Wiebe | 232/35 |
| 4,113,170 | 9/1978 | Hansicker | 232/35 |

*Primary Examiner*—Gene Mancene
*Assistant Examiner*—John G. Weiss
*Attorney, Agent, or Firm*—Duckworth, Allen, Dyer & Pettis

[57] ABSTRACT

A rural mailbox signaling device actuated by opening of the mailbox door. A brightly colored signal rod is pivotally mounted along the top surface of the mailbox and biased in an upright position by a spring. A locking pin is pivoted at the distal end of the signal rod and is swung to a right angle position when setting the device. The door is closed and the signal rod forced against the spring to a horizontal position. The locking pin is swung to a coaxial extended position engaging a hook member attached to the door latch which holds the signal rod horizontal. When the mailman opens the door to deposit mail, the signal rod is released and flips to the upright position.

5 Claims, 4 Drawing Figures

MAILBOX DELIVERY SIGNAL DEVICE

BACKGROUND OF THE INVENTION

1. Field of the Invention

The present invention relates to an indicator attached to a rural-type mailbox and more particularly to an indicator which indicates that the mailbox door had been opened and mail deposited.

2. Description of the Prior Art

It has been known to provide flags of various types which can be visible from a distance to indicate that the mailman has placed a delivery in the box. The following United States patents, for example, disclose such devices: U.S. Pat. No. 3,596,631 to Sutton; U.S. Pat. No. 3,516,383 to Goodman; U.S. Pat. No. 3,482,543 to Guidos; U.S. Pat. No. 2,482,423 to Hurban; U.S. Pat. No. 3,866,823 to Grayson; U.S. Pat. No. 4,000,847 to Duis; U.S. Pat. No. 4,138,056 to Sherrill; and U.S. Pat. No. 4,171,086 to Hudson. However, none of these devices are believed to be on the market and apparently were not successful in meeting the need for this type of device.

SUMMARY OF THE INVENTION

The present invention is a mailbox signaling device which is automatically actuated when the mailman opens the door of a rural-type mailbox to leave mail. The signal is a rod or tube which may be on the order of 12 inches in length mounted along the top surface of a rural mailbox. The signal rod includes a pivot at the base which is spring loaded to normally maintain an upright position. The signal rod may be painted bright contrasting colors; for example, red, white, and blue. At the distal end of the signal rod, a lock pin is pivotally attached such that in one position the pin is aligned and concentric with the signal rod and can be pivoted to a second position at right angles to the rod.

A hook member is attached to the upper end of the mailbox door such that when the door is in its closed position, the hook extends slightly above the door catch. To set the indicator, the door is closed and the lock pin is pivoted to its right angle position. The signal rod is then folded downward from its normal upright position against the spring until it is parallel with the top surface of the mailbox. The length of the signal rod and location of the pivot point is selected to place the distal end of the signal rod in the down position immediately adjacent the hook. The lock pin is then pivoted to its concentric position thereby engaging the hook which holds the indicator rod in the down position.

When the mailman opens the door of the box to place mail therein, the hook releases the locking pin permitting the indicator rod to flip to its upright position. Thus, the indicator rod may be seen from a distance indicating that mail has been delivered to the box.

It is therefore a principal object of the invention to provide a simple, easy-to-operate mailbox signal for indicating when mail has been delivered to a rural-type mailbox.

It is another object of the invention to provide a mail delivery indicator which is operated by opening of the mailbox door.

It is still another object of the invention to provide a mail delivery indicating device for a rural-type mailbox which will be attractive in either the operative or non-operative position.

These and other objects and advantages of the invention will become apparent from the following detailed description and the drawings.

DETAILED DESCRIPTION OF THE PREFERRED EMBODIMENT

Figure 1:
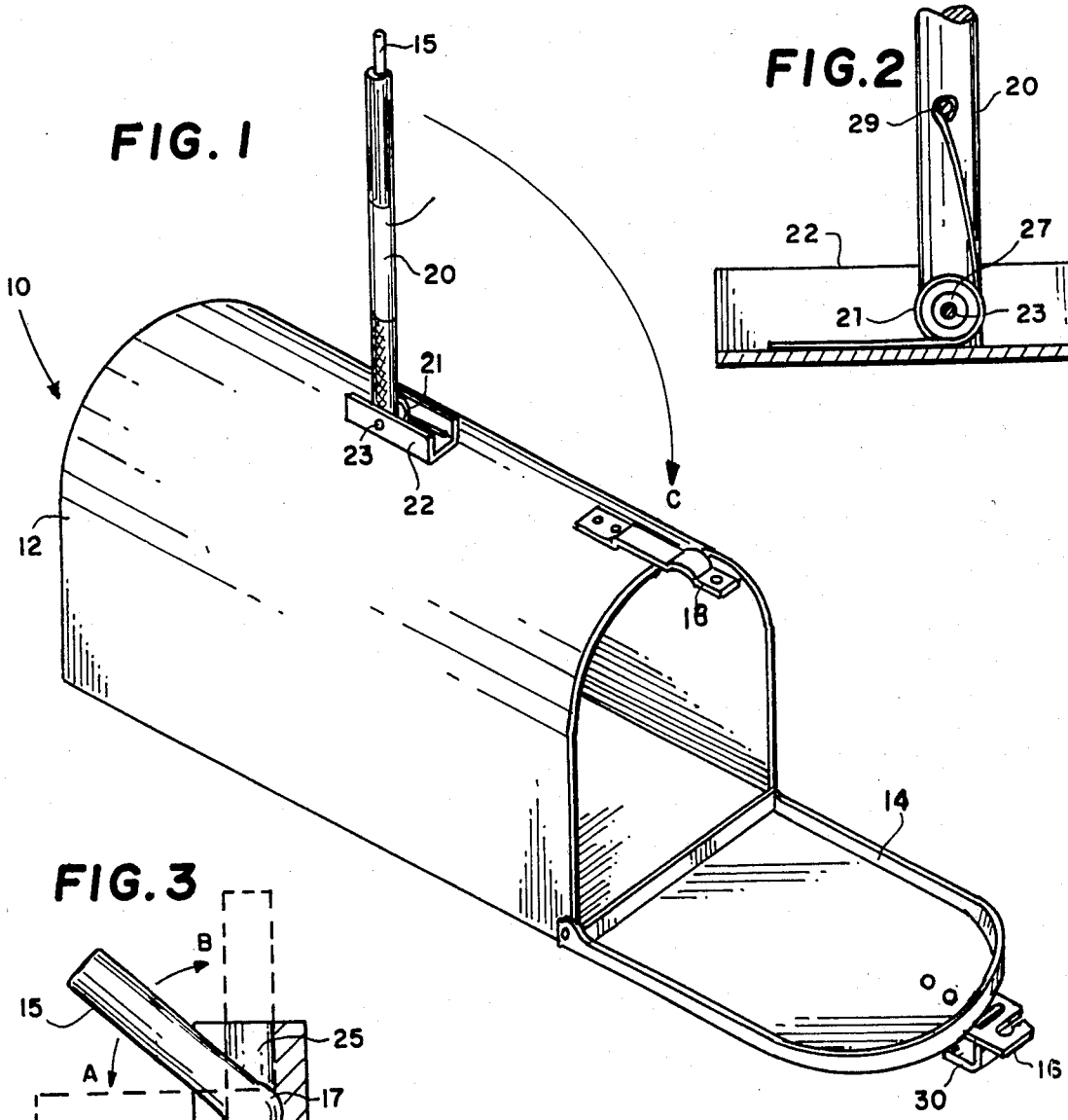
FIG. 1 is a perspective view of a rural mailbox having my mailbox signal indicator attached thereto.
Figure 2:
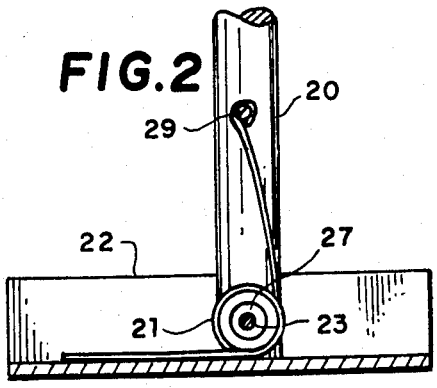
FIG. 2 is a cross sectional view of the signal arm mounting channel showing the spring loading arrangement.
Figure 3:
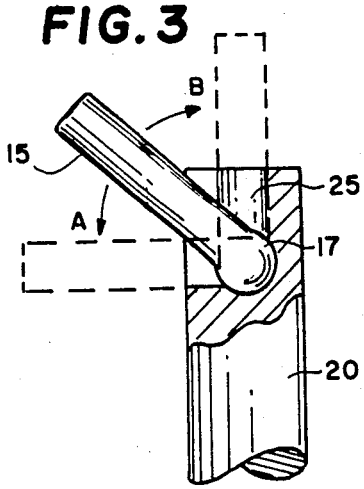
FIG. 3 is a partial cross sectional view of the distal end of the signal arm showing the mounting of the locking pin.

Referring to FIG. 1, a rural-type mailbox 10 is shown having a housing portion 12 and a door 14. An indicator arm 20 which may be a cylindrical rod or section of tubing is shown in its vertical or actuated position. Arm 20 may be fabricated from a plastic material which will withstand the weather such as PVC. Other suitable materials include wood and metal. Signal arm 20 is mounted to a channel 22 by pivot 23. As best seen in FIG. 2, a spring 21 has one end attached to the arm 20 by screw 29 with the other end bearing on the base of channel 22. The bottom or proximal end of arm 20 is relieved toward the front of mailbox 10 such that it may be folded downward at right angles to the position shown in FIGS. 1 and 2, tightening spring 21. Therefore, spring 21 serves to bias arm 20 toward the upright position. A washer 27 around pivot 23 may also be provided to maintain spring 21 approximately centered about pivot 23. At the upper or distal end of arm 20, I have provided a locking pin 15 mounted as shown in FIG. 3. In this view a cross section of the distal end of arm 20 is shown having a relieved portion 25. Locking pin 15 includes a ball shaped end 17 which snaps into a complementary ball shaped recess in relieved portion 25. Locking pin 15 may be placed in either of two operative positions shown by the dash lines A for the first position and the dash lines B for the second position.

Figure 4:
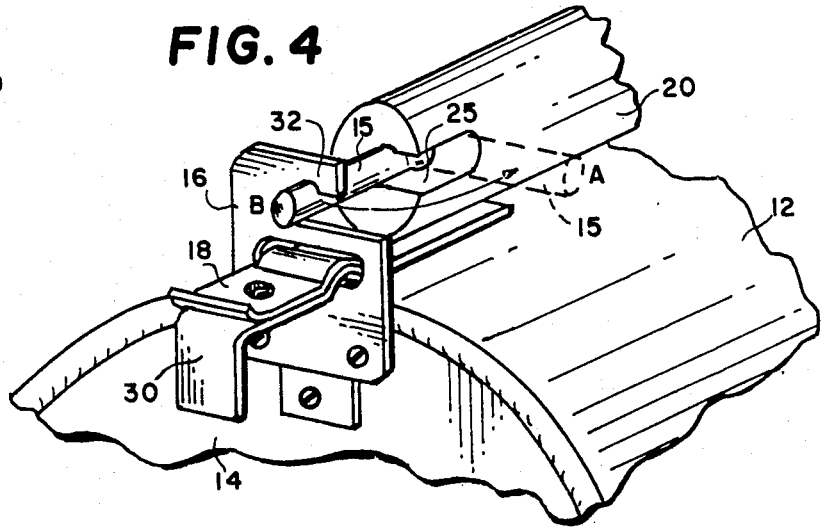
FIG. 4 is a partial perspective view of the latch portion of the mailbox of FIG. 1 in its closed position with the signal arm locked in the down or closed position.

Turning now to FIG. 4, the manner of setting the signal arm 20 may be seen. The user first closes door 14 causing latch portion 18 to engage handle 30 in the normal fashion for a rural mailbox. It may be noted that latch 18, which normally has an upward projecting tab, has been modified by removing the tab. A hook plate 16 is provided and attached to door 14 over the original handle bracket 30, hook plate 16 having an opening therethrough as shown. The upper end of hook plate 16 has an open hook 32 which engages lock pin 15 when arm 20 is in the set position.

After closing door 14 to permit latch 18 to engage handle 30 and locking the door 14 in its closed position, the user then forces signal arm 20 down against the tension of spring 21 to the position shown in FIG. 4 having first rotated lock pin 15 to the A position as shown by the dashed lines in FIG. 4. Holding signal arm 20 in the down position, the user flips lock pin 15 from the A position the the B position in the direction of the arrow as shown, releasing pressure on signal arm 20 causing the hook 32 to thereafter hold the arm in the down position.

As may now be understood, when the mailman opens door 14 to insert mail into mailbox 10, he pulls handle 30 forward causing hook 32 to release lock pin 15. Spring 21 then snaps signal arm 20 to the upright position as shown in FIG. 1. In this position, an occupant of the house can easily see the signal arm at a reasonable distance to determine if mail has been delivered. After removing the mail from mailbox 10, the user resets signal arm 20 as previously described preparatory for the following day's mail.

For the preferred embodiment of my invention, I prefer to ultilize an aluminum channel 22 and a PVC tubing section for signal arm 20. In this case, I utilize a plastic insert into the PVC tubing for the relieved area of the distal end shown in FIG. 3 which provides a socket for ball end 17 of locking pin 15. I also prefer to paint the signal arm 20 in bright colors to improve visibility. For example, an appropriate color scheme is red, white, and blue.

I claim:

1. In a rural mailbox having a door, a signaling device comprising:

a cylindrical signal rod having a proximal end pivotally attached to the top surface of said mailbox and a ball-shaped recess in its distal end;

a spring means attached to said signal rod for biasing said rod toward a vertical position relative to said top surface;

a cylindrical locking pin having a ball-shaped proximal end adapted to snap into said ball-shaped recess of said signal rod, said locking pin adjustable to either a first position coaxial with said signal or to a second right angle position relative to said signal rod; and a hook member attached to said door for engaging said locking pin when in said first position and said signal rod is disposed in a horizontal position relative to said top surface and said door is closed and adapted to release said locking pin when said door is opened permitting said spring means to move said signal rod to said vertical position.

2. The device as defined in claim 1 which further comprises a pivot bracket attached to said top surface.

3. The device as defined in claim 1 in which said signal rod includes stop means to maintain said signal rod in said vertical position after release of said locking pin.

4. The device as defined in claim 1 in which said signal rod is brightly colored.

5. The device as defined in claim 1 in which said locking pin is movable to said right angle position when said door is closed and said signal rod is moved from said vertical position to said horizontal position and said locking pin is thereafter movable to engage said hook member.

* * * * *